US006700470B2

(12) United States Patent
Butler, Jr. et al.

(10) Patent No.: US 6,700,470 B2
(45) Date of Patent: Mar. 2, 2004

(54) IGNITION APPARATUS HAVING INCREASED LEAKAGE TO CHARGE ION SENSE SYSTEM

(75) Inventors: Raymond O. Butler, Jr., Anderson, IN (US); Mark Albert Paul, Fishers, IN (US); Albert Anthony Skinner, Anderson, IN (US)

(73) Assignee: Delphi Technologies, Inc., Troy, MI (US)

( * ) Notice: Subject to any disclaimer, the term of this patent is extended or adjusted under 35 U.S.C. 154(b) by 69 days.

(21) Appl. No.: 10/013,734

(22) Filed: Dec. 10, 2001

(65) Prior Publication Data

US 2003/0107461 A1 Jun. 12, 2003

(51) Int. Cl.[7] ..... H01F 27/02

(52) U.S. Cl. ..... 336/96; 336/92; 336/90; 29/602.1

(58) Field of Search ..... 336/90, 92, 96; 23/435, 425; 29/602.1, 605; 324/399

(56) References Cited

U.S. PATENT DOCUMENTS

| | | | | | |
|---|---|---|---|---|---|
| 5,483,818 | A | * | 1/1996 | Brandt et al. | 73/35.01 |
| 5,785,020 | A | | 7/1998 | Takahashi et al. | 123/425 |
| 5,866,808 | A | * | 2/1999 | Ooyabu et al. | 73/116 |
| 5,886,476 | A | * | 3/1999 | Skinner et al. | 315/209 T |
| 6,040,698 | A | | 3/2000 | Takahashi et al. | 324/399 |
| 6,054,859 | A | | 4/2000 | Takahashi et al. | 324/399 |
| 6,092,015 | A | | 7/2000 | Takahashi et al. | 701/101 |
| 6,114,935 | A | | 9/2000 | Oosuka et al. | 336/107 |
| 6,186,129 | B1 | | 2/2001 | Butler, Jr. | 123/459 |
| 6,215,385 | B1 | | 4/2001 | Ogden | 336/96 |
| 6,360,587 | B1 | * | 3/2002 | Noel | 73/35.08 |
| 6,408,242 | B1 | * | 6/2002 | Tozzi | 701/114 |
| 6,498,490 | B2 | * | 12/2002 | Karau et al. | 324/380 |

OTHER PUBLICATIONS

Moga et al, "Ignition Apparatus Having Feature for Shielding the HV Terminal," USSN 09/932267 filed Aug. 17, 2001.

Moga et al, "Improved Connection of Wire to Printed Circuit Baord (PCB)," USSN 09/938991 filed Aug. 24, 2001.

Paul et al, "Ignition Apparatus Having Reduced Electric Field HV Terminal Arrangement," USSN 09/971234 filed Jul. 02, 2001.

* cited by examiner

*Primary Examiner*—Anh Mai
(74) *Attorney, Agent, or Firm*—Jimmy L. Funke

(57) ABSTRACT

An ignition apparatus includes a central core extending along a main axis, and a primary winding disposed radially outwardly thereof. The ignition apparatus further includes a secondary winding. The primary winding has a greater axial length than the secondary winding, this additional axial length being implemented on the low-voltage axial end of the ignition apparatus, relative to the main axis. The extended primary winding provides an increased leakage inductance spike, which may be used by an ion sense system to (i) obtain increased bias voltages, and, (ii) increase the effective turns ratio, thereby reducing the amount of wire required for the secondary winding.

15 Claims, 2 Drawing Sheets

IGNITION APPARATUS HAVING INCREASED LEAKAGE TO CHARGE ION SENSE SYSTEM

BACKGROUND OF THE INVENTION

1. Technical Field

The present invention relates generally to an ignition apparatus for developing a spark firing voltage that is applied to one or more spark plugs of an internal combustion engine, and more particularly, to a system configured for ion current measurement within a combustion chamber of the engine.

2. Discussion of the Background Art

So-called ion sense systems are known for detecting a combustion condition (e.g., misfire, knock). The combustion of an air/fuel mixture in an engine results in molecules in the cylinder being ionized. Applying a relatively high voltage across, for example, the electrodes of a spark plug just after ignition is known to produce a current across the electrodes. Such current is known as an ion current. The ion current that flows is proportional to the number of combustion ions present in the area of, for example, the spark plug gap referred to above, and consequently corresponds in some measure to the ionization throughout the entire cylinder as combustion occurs. The DC level or amount of ion current is indicative of a quantity of combustion, or whether in fact combustion has occurred at all (e.g., a misfire condition). An AC level of the ion current may be used to determine whether knock exists. The ion sense approach is effective for any number of cylinders, and various engine speed and load combinations.

Known ion current sensing systems generally include a capacitor or the like configured to store a voltage. The stored voltage is thereafter used as a "bias" voltage, which is applied to the spark plug to generate the ion current. One approach taken in the art involves using the voltage from a leakage inductance spike from the primary side of the ignition coil to charge a capacitor for biasing the spark plug, as seen by reference to U.S. Pat. No. 6,186,129 entitled "ION SENSE BIASING CIRCUIT," issued to Butler. Because of relatively good flux coupling between primary and secondary windings in "pencil" coils (i.e., a relatively slender ignition coil configuration that is adapted for mounting directly above the spark plug), bias voltages of approximately 100 volts are about the maximum that can be achieved (i.e., the leakage inductance spike is limited by the relatively high coupling). While biasing at about 100 volts is adequate for most combustion conditions, it is nonetheless desirable to bias at higher voltage levels under certain other conditions, for example, in highly dilute or lean conditions.

U.S. Pat. No. 6,114,935 entitled "IGNITION COIL HAVING COIL CASE," issued to Oosuka et al. disclose an ignition coil extending along an axis, where the longitudinal extent of a secondary coil is about the same as the longitudinal extent of the primary coil, which is generally conventional construction for coupling primary flux to the secondary coil.

There is therefore a need to provide an ignition apparatus and an ignition system that improves upon one or more of the configurations set forth above.

SUMMARY OF THE INVENTION

An object of the present invention is to provide a solution to one or more of the problems set forth above. An increased leakage inductance spike would be required to charge the ion sense system for biasing at the increased voltage levels. One advantage of the present invention is that it provides such a configuration that increases a leakage inductance spike, which may be used by an ion sense system in providing an increased bias voltage level. This has the advantage of more effectively operating in highly dilute or lean conditions. Another advantage is that it provides an ignition apparatus having an increased, effective turns ratio ($N_S$:$N_P$), thereby allowing a reduction in the amount of secondary wire used, which is typically the number one raw material cost in an ignition coil. This feature reduces cost. Still yet another advantage of the present invention is that as bias voltages increase, the invention decreases waste of potential spark energy.

In accordance with the present invention, an ignition apparatus is provided that includes a central core and primary and secondary windings. The central core extends along a main axis, and the primary winding is disposed about the central core. The secondary winding is also disposed about the central core. The primary winding is extended relative to the secondary winding. That is, the primary winding has a first axial length, and the secondary winding has a second axial length that is less than the first axial length. The primary winding extension decreases flux coupling, thereby increasing a leakage inductance spike.

In a preferred embodiment, the ignition apparatus is arranged so that first and second layers thereof extend approximately the same axial length as the secondary winding, with one or more additional layers being wound to extend beyond the secondary winding at the low voltage end of the secondary winding.

In another aspect of the present invention, the above-described ignition apparatus is coupled to an ion sense biasing circuit that is coupled to the primary winding for charging thereof and is further configured to bias a spark plug coupled to a high voltage end of the secondary winding to produce an ion current indicative of a combustion condition.

BRIEF DESCRIPTION OF THE DRAWINGS

The present invention will now be described by way of example, with reference to the accompanying drawings.

DETAILED DESCRIPTION OF THE PREFERRED EMBODIMENTS

Figure 1:
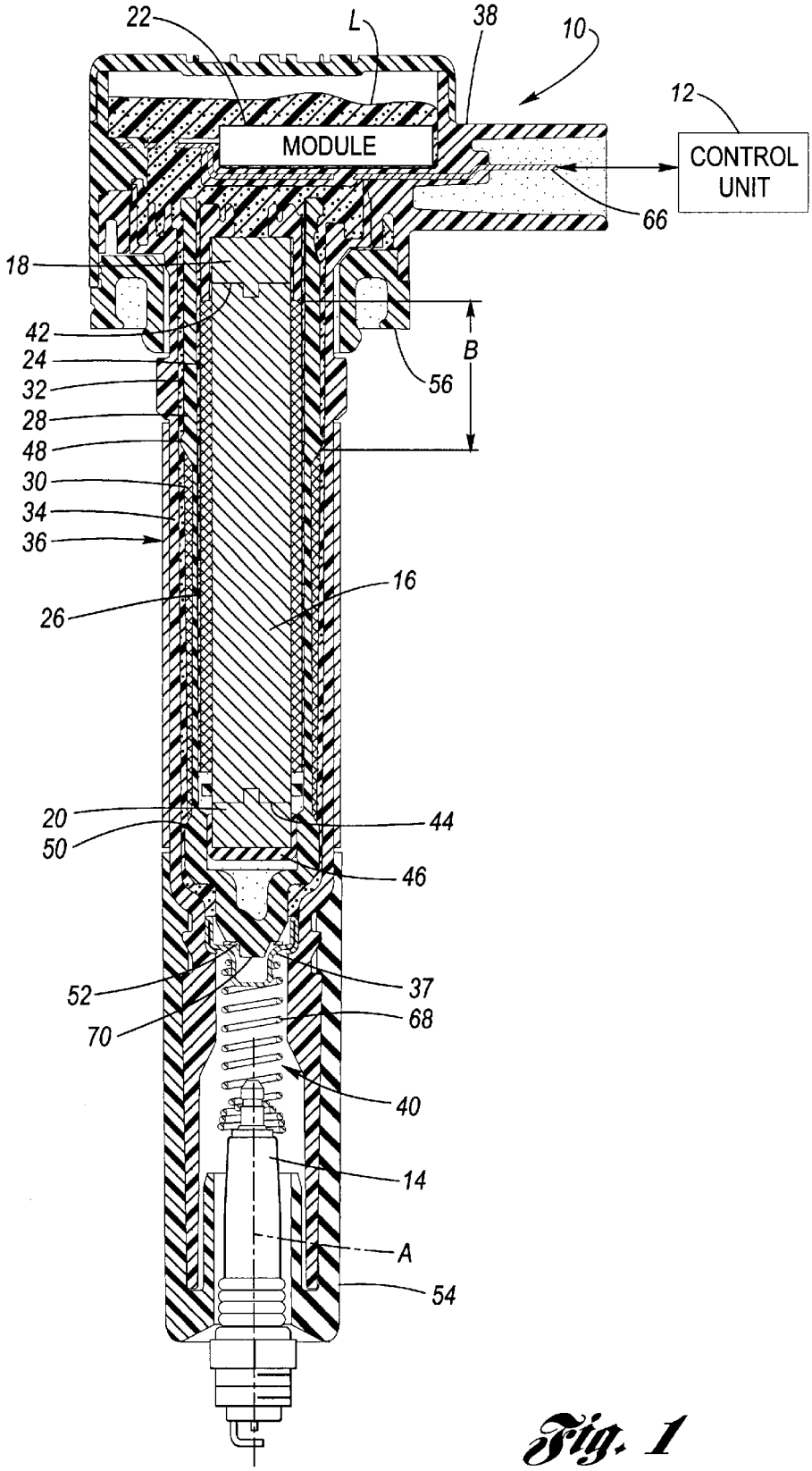
FIG. 1 is a simplified cross-sectional view of an ignition apparatus having a primary winding extension according to the present invention.

Referring now to the drawings wherein like reference numerals are used to identify identical components in the various views, FIG. 1 illustrates an ignition apparatus or coil 10 in simplified, cross-sectional form. Ignition apparatus 10 may be coupled to, for example, a control unit 12, which may contain primary energization control circuitry for controlling the charging and discharging of ignition apparatus 10. The relatively high voltage produced by ignition apparatus 10 is provided to a spark plug 14 for producing a spark across a spark gap thereof, which may be employed to initiate combustion in a combustion chamber of an internal combustion engine.

Ignition apparatus 10 is adapted for installation to a conventional internal combustion engine through a spark plug well onto a high voltage terminal of the spark plug, which in turn may be retained by a threaded engagement with a spark plug opening in the above-described combustion cylinder. The engine may provide power for locomotion of a self-propelled vehicle, such as an automotive vehicle. In addition, ignition apparatus 10 may include ion sense capability integral therewith, and in particular, an ion sense system having means for biasing the spark plug gap immediately after sparking, and which is charged by a leakage inductance spike taken off of the primary side of the apparatus, for example, as disclosed in U.S. Pat. No. 6,186,129 entitled "ION SENSE BIASING CIRCUIT," assigned to the common assignee of the present invention, hereby incorporated by reference in its entirety. It should be understood that the ion sense system may be separate from ignition apparatus 10, and nonetheless have the same functionality.

FIG. 1 further shows a core 16, an optional first magnet 18, an optional second magnet 20, an electrical module 22, a primary winding 24, a first layer of encapsulant such as an epoxy potting material layer 26, a secondary winding spool 28, a secondary winding 30, a second layer 32 of encapsulant such as epoxy potting material, a case 34, a shield assembly 36, an electrically conductive cup 37, a low-voltage (LV) connector body 38, and a high-voltage (HV) connector assembly 40. Core 16 is elongated, extending along a main axis designated "A," and includes a top end 42 and a bottom end 44. FIG. 1 further shows a rubber buffer cup 46, annular flange portions 48, 50 of secondary spool 28, a high voltage (HV) secondary terminal 52, a boot 54, and a seal member 56.

As described in the Background, one area that can be improved relative to the known art relates to the voltage level at which biasing is conducted during ion sense operation (when using a leakage inductance spike from the primary side to charge a capacitor for biasing an ion sense circuit). One way to increase the leakage inductance spike produced off of the primary winding when the primary current is interrupted (i.e., when a spark is commanded), is to extend the primary winding relative to the secondary winding so as to decrease the level of flux coupling therebetween. As shown in FIG. 1, primary winding 24 has a first axial length, and secondary winding 30 has a second axial length that is less than the first axial length, by an amount designated "B." In the embodiment shown in FIG. 1, the respective lowermost portions of the primary winding 24 and secondary winding 30 are substantially aligned, axially, with respect to longitudinal axis "A." The primary winding extension is preferably implemented proximate the upper, low-voltage end of the ignition apparatus 10 (i.e., closer to upper end 42 of core 16 than to the lower end 44). Further, as shown diagrammatically in FIG. 1, in a first embodiment, the primary winding 24 comprises a plurality of layers, all of the layers being about the same axial length and ending at substantially the same axial position (i.e., relative to axis "A").

In a constructed embodiment, the primary winding 24 contained 210 turns of 24 AWG copper, insulated wire, arranged in 2 layers. The secondary winding 30 contained about 15,660 turns of 46 AWG copper, insulated wire, arranged in a progressively wound manner. The axial length of the secondary winding was about 45.5 mm, while the axial length of the primary winding was about 57.9 mm, yielding a 14.4 mm extension.

Figure 2:
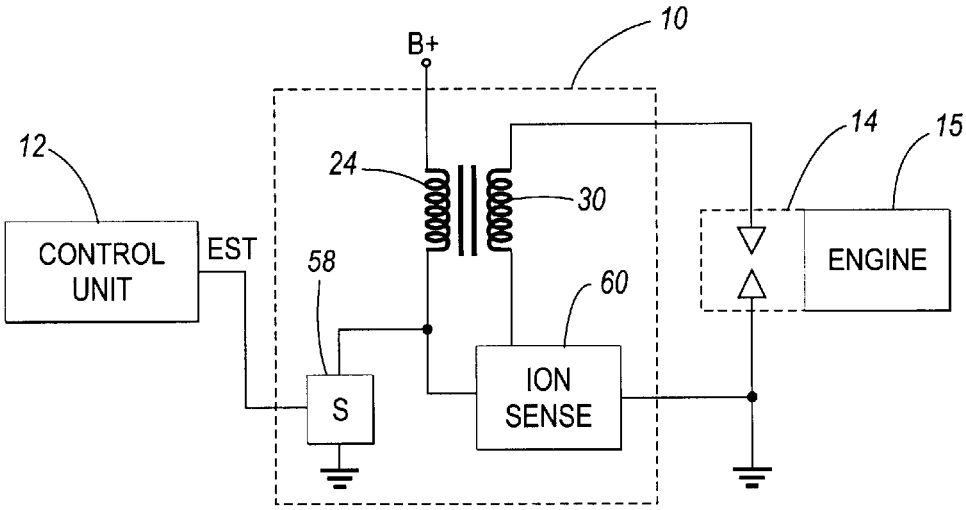
FIG. 2 is a simplified schematic and block diagram view of the ignition system shown in FIG. 1.

FIG. 2 is a simplified schematic and block diagram view of the ignition system of FIG. 1. In addition to the components illustrated in FIG. 1, FIG. 2 further shows a switch 58, which may comprise conventional switching components (i.e., IGFET, MOSFET, bipolar transistor, or the like), and an ion sense system 60. Ion sense system 60 includes means or circuit for biasing spark plug 14 that is coupled to primary winding 24, and is configured to capture a leakage inductance spike therefrom for charging a capacitor or the like, as described in U.S. Pat. No. 6,186,129 entitled "ION SENSE BIASING CIRCUIT" issued to Butler, referred to above and herein incorporated by reference. The ion sense block 60 is further configured to bias spark plug 14 which is coupled to a high voltage end of secondary winding 30 so as to produce an ion current indicative of a combustion condition, as known by those of ordinary skill in the art. Control unit 12, as known, is configured to generate an electronic spark timing (EST) signal that determines when charging is to commence (i.e., when the EST signal transitions from a logic low, to a logic high state), the duration of charging (i.e., how long the EST signal is asserted), and when the spark is to occur (i.e., when the EST signal is discontinued).

Figure 3:
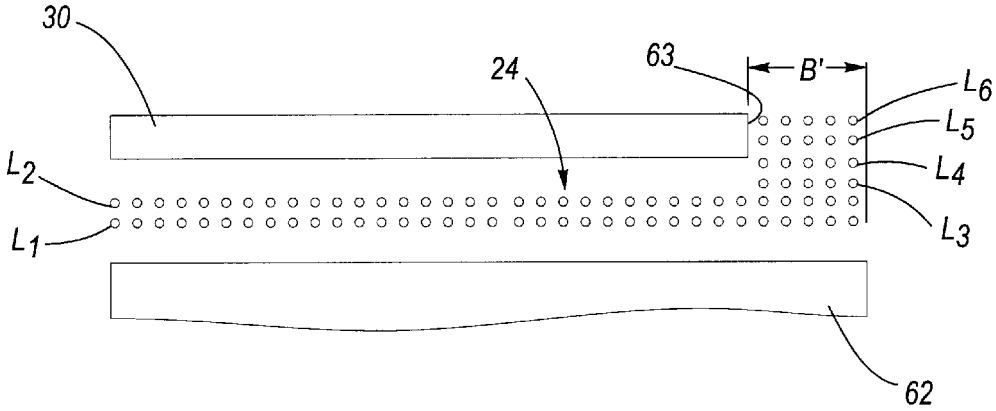
FIG. 3 is a diagrammatic view showing an alternative embodiment of a primary winding extension according to the invention.

FIG. 3 shows an alternative embodiment according to the present invention wherein primary winding 24 is shown having a different configuration. Structure 62 may be a primary winding spool, or may be a core 16. As shown in FIG. 3, in order to obtain an increased leakage inductance spike, a section of the primary winding turns are placed outside of the main flux path with the secondary winding 30. In the illustrated embodiment, two layers, designated $L_1$ and $L_2$, are wound so as to extend a first axial length. The secondary winding 30 extends a second axial length that is less than the first axial length. Further layers, such as a third and a fourth layer, designated $L_3$ and $L_4$, are then wound so as to have a third axial length that is foreshortened relative to said first axial length layers. $L_3$ and $L_4$ are also axially spaced apart from the low-voltage end 63 of secondary winding 30. In this embodiment, the extension is designated by an axial distance B'. Additional layers, such as a fifth and a sixth layer, designated $L_5$ and $L_6$, may be further added depending on the level of the leakage inductance spike desired for any particular design. As with the first embodiment in FIG. 1, the primary winding extension B' in this embodiment occurs at the low voltage end 63 of the secondary winding, with respect to longitudinal axis "A." As with the embodiment of FIG. 1, the flux created by the primary winding 24 (by way of layers $L_1$–$L_6$, in the illustrated embodiment) would only be partially coupled to secondary winding 30, and a predetermined portion of the energy stored in this flux would be delivered as a leakage inductance spike to charge a capacitor (or other storage element) contained in ion sense system 60, as described above.

In addition, another advantage of the present invention relates to an effective increase in the turns ratio ($N_S$:$N_P$), which is beneficial in a variety of different respects. First, the wire used for the secondary winding 30 is typically one of the most significant, if not the most significant, raw material cost in an ignition coil. Thus, the higher the turns ratio, the higher the cost (due to more copper). If one could increase the effective turns ratio without actually increasing the number of turns in the secondary, a cost savings would be realized.

In addition, in many design situations, long burn times are specified, therefore requiring a high turns ratio.

The following is an analysis of the burn time relationship to the turns ratio. The energy available to the secondary (hereinafter "Ea"), is given by equation (1) below.

$$Ea = \text{Estored} - \text{switch loss} - \text{core loss} \quad (1)$$

Assuming a linear system, the energy available to the secondary is dissipated in two principal places, namely, across the spark plug gap, and through a zener diode conventionally employed in the secondary circuit of an ignition coil, as set forth in equation (2) below.

$$Ea=(V_{ZENER}\times I_{S\ PEAK}\times T_{BURN})+(I^{2S\ PEAK}\times R_S\times T_{BURN})/3 \quad (2)$$

The burn time can be solved for by rearranging equation (2) to yield equation (3) set forth below.

$$T_{BURN}=Ea/((V_{ZENER}\times I_{S\ PEAK})+(I^2{}_{S\ PEAK}\times R_S)/3) \quad (3)$$

The peak secondary current set forth in equations (2) and (3) is provided for in equation (4) below.

$$I_{S\ PEAK}\approx K_{COUPLING}\times I_{P\ PEAK}/(\text{TurnsRatio}) \quad (4)$$

Therefore, as a natural consequence of equation (4), as the turns ratio ($N_S$:$N_P$) goes down, the peak secondary current goes up, assuming the same coupling. As the peak secondary current increases, the burn time decreases. Therefore, to obtain increased burn times, conventionally, the turns ratio would have to be increased. If one could increase the effective turns ratio without actually adding turns, then increased burn times could be obtained without cost penalties.

In addition, lower clamp voltages with respect to switch 58 also drive higher turns ratios. Specifically, the secondary output (i.e., voltage output) is limited to approximately the primary side clamp voltage times the turns ratio. If one could increase the effective turns ratio, the output voltage could be increased. To obtain any of the foregoing, with the secondary and the primary windings at the same length, the only practical way to increase the turns ratio is to increase the actual number of turns in the secondary winding. This increases cost.

However, if you include a primary winding extension according to the invention, you can increase the effective turns ratio without actually increasing the number of secondary winding turns. Let P=permanence, the Φ=flux, N=Turns, and AT=amp-turns. From the foregoing, equations (5), (6) and (7) are set forth below.

$$P\equiv\Phi/AT \quad (5)$$

$$AT=\Phi/P \quad (6)$$

$$I_S=AT/N_S \quad (7)$$

Therefore $I_S\propto 1/P$, and $P\propto\Phi$. Using the magnetic vector potential (A) to get a relative value for the flux normalized per turn by the following equation, $\Phi\propto(\Sigma A\times N/\Sigma N)$, and multiplying the ratio of these values for a conventional design (i.e., where the primary length is equal to the secondary length), and the extended primary by the secondary current expected from the turns ratio, this calculated value for secondary current substantially approximates the measured current.

EXAMPLE

For a conventional design where the axial length of the primary winding is substantially equal to the axial length of the secondary winding, the quantity ($\Sigma A\times N/\Sigma N$) is determined over the axial length was $1.5478\times10^{-3}$ wb/m. The same calculation was made for an ignition apparatus according to the invention having an extended primary winding, and the quantity ($\Sigma A\times N/\Sigma N$) over the axial length was $2.037466\times10^{-3}$. Given the equations referred to above, the peak secondary current for the conventional design where the primary winding axial length was substantially equal to the secondary winding axial length, was approximately 63.6 ma (average). See equation (8) for the calculated level when lp≈ls.

$$I_S=(0.93)(I_P/N)=(0.93)(7.2)/105=0.0638A \quad (8)$$

The calculated (expected) secondary current for the extended primary ignition apparatus according to the invention is 51.8 mA for the peak secondary current as shown by equation (9). The measured average for a constructed embodiment was 50.3 ma (average).

$$I_S=63.6\times(105/98)\times(1.5478/2.037466)=51.8\ \text{mA} \quad (9)$$

Therefore, $N_{EFFECTIVE}=(0.93)I_P/I_S=(0.93)(7.2)/(0.0518)=129.3$.

Note, that the actual turns ratio decreased from 105:1 to 98:1, thereby reducing the amount of secondary wire needed for the ignition apparatus. However, the effective turns ratio was increased to approximately 129:1, which saved approximately 25% of the secondary wire cost, over adding turns to yield the same effect.

Referring again to FIG. 1, further details concerning ignition apparatus 10 will now be set forth configured to enable one to practice the present invention. It should be understood that portions of the following are exemplary only and not limiting in nature. Many other configurations are known to those of ordinary skill in the art and are consistent with the teachings of the present invention. Central core 16 may be elongated, having a main, longitudinal axis "A" associated therewith. Core 16 may be a conventional core known to those of ordinary skill in the art. As illustrated, core 16, in the preferred embodiment, takes a generally cylindrical shape (which is a generally circular shape in radial cross-section), and may comprise compression molded insulated iron particles or laminated steel plates, both as known.

Magnets 18 and 20 may be optionally included in ignition apparatus 10 as part of the magnetic circuit, and provide a magnetic bias for improved performance. The construction of magnets such as magnets 18 and 20, as well as their use and effect on performance, is well understood by those of ordinary skill in the art. It should be understood that magnets 18 and 20 are optional in ignition apparatus 10, and may be omitted, albeit with a reduced level of performance, which may be acceptable, depending on performance requirements.

Module 22 may be configured to perform a switching function, such as connecting and disconnecting an end of primary winding to ground. Additionally, the module may include the ion sense system 60 described above.

Primary winding 24 generally may be wound directly onto core 16 in a manner known in the art. Primary winding 24 includes first and second ends and is configured to carry a primary current $I_P$ for charging apparatus 10 upon control of control unit 12 of module 22. Winding 24 may be implemented using known approaches and conventional materials consistent with the foregoing principles. Although not shown, primary winding 24 may be wound on a primary winding spool (not shown) in certain circumstances (e.g., when steel laminations are used). In addition, winding 24 may be wound on an electrically insulating layer that is itself disposed directly on core 16.

Layers 26 and 32 comprise an encapsulant suitable for providing electrical insulation within ignition apparatus 10. In a preferred embodiment, the encapsulant comprises epoxy potting material. The epoxy potting material introduced in layers 26, and 32 may be introduced into annular potting channels defined (i) between primary winding 24 and secondary winding spool 28, and, (ii) between secondary winding 30 and case 34. The potting channels are filled with potting material, in the illustrated embodiment, up to approximately the level designated "L" in FIG. 1. In one embodiment, layer 26 may be between about 0.1 mm and 1.0 mm thick. Of course, a variety of other thicknesses are possible depending on flow characteristics and insulating characteristics of the encapsulant and the design of the coil 10. The potting material also provides protection from environmental factors which may be encountered during the service life of ignition apparatus 10. There is a number of suitable epoxy potting materials well known to those of ordinary skill in the art.

Secondary winding spool 28 is configured to receive and retain secondary winding 30. In addition to the features described above, spool 28 is further characterized as follows. Spool 28 is disposed adjacent to and radially outwardly of the central components comprising core 16, primary winding 24, and epoxy potting layer 26, and, preferably, is in coaxial relationship therewith. Spool 28 may comprise any one of a number of conventional spool configurations known to those of ordinary skill in the art. In the illustrated embodiment, spool 28 is configured to receive one continuous secondary winding (e.g., progressive winding) on an outer winding surface thereof, between upper and lower flanges 48 and 50 ("winding bay"), as is known. However, it should be understood that other configurations may be employed, such as, for example only, a configuration adapted for use with a segmented winding strategy (e.g., a spool of the type having a plurality of axially spaced ribs forming a plurality of channels therebetween for accepting windings) as known.

The depth of the secondary winding in the illustrated embodiment may decrease from the top of spool 28 (i.e., near the upper end 42 of core 16), to the other end of spool 28 (i.e., near the lower end 44) by way of a progressive gradual flare of the spool body. The result of the flare or taper is to increase the radial distance (i.e., taken with respect to axis "A") between primary winding 24 and secondary winding 30, progressively, from the top to the bottom. As is known in the art, the voltage gradient in the axial direction, which increases toward the spark plug end (i.e., high voltage end) of the secondary winding, may require increased dielectric insulation between the secondary and primary windings, and, may be provided for by way of the progressively increased separation between the secondary and primary windings.

Spool 28 is formed generally of electrical insulating material having properties suitable for use in a relatively high temperature environment. For example, spool 28 may comprise plastic material such as PPO/PS (e.g., NORYL available from General Electric) or polybutylene terephthalate (PBT) thermoplastic polyester. It should be understood that there are a variety of alternative materials that may be used for spool 28 known to those of ordinary skill in the ignition art, the foregoing being exemplary only and not limiting in nature.

Features 48 and 50 may be further configured so as to engage an inner surface of case 34 to locate, align, and center the spool 28 in the cavity of case 34 and providing upper and lower defining features for a winding surface therebetween.

Spool 28 may have associated therewith an electrically conductive (i.e., metal) high-voltage (HV) terminal 52 disposed therein or in contact therewith configured to engage cup 37, which cup is in turn electrically connected to the HV connector assembly 40. The body of spool 28 at a lower end thereof is configured so as to be press-fit into the interior of cup 37 (i.e., the spool gate portion).

FIG. 1 also shows secondary winding 30 in cross-section. Secondary winding 30, as described above, is wound on spool 28, and includes a low voltage end and a high voltage end. The low voltage end may be connected to ground by way of a ground connection through LV connector body 38 in a manner known to those of ordinary skill in the art. The high voltage end is connected to HV terminal 52. Winding 30 may be implemented using conventional approaches and material known to those of ordinary skill in the art.

Case 34 includes an inner, generally enlarged cylindrical surface, an outer surface, a first annular shoulder, a flange, an upper through-bore, and a lower through bore.

The inner surface of case 34 is configured in size to receive and retain spool 28 which contains the core 16 and primary winding 24. The inner surface of case 34 may be slightly spaced from spool 28, particularly the annular features 48, 50 thereof (as shown), or may engage the features 48, 50.

A lower through-bore is defined by an inner surface thereof configured in size and shape (i.e., generally cylindrical) to accommodate an outer surface of cup 37 at a lowermost portion thereof as described above. When the lowermost body portion of spool 28 is inserted in the lower bore containing cup 37, a portion of HV terminal 52 engages an inner surface of cup 37 (also via a press fit) as shown.

Case 34 is formed of electrical insulating material, and may comprise conventional materials known to those of ordinary skill in the art (e.g., the PBT thermoplastic polyester material referred to above).

Shield 36 is generally annular in shape and is disposed radially outwardly of case 34, and, preferably, engages an outer surface of case 34. The shield 36 preferably comprises electrically conductive material, and, more preferably metal, such as silicon steel or other adequate magnetic material. Shield 36 provides not only a protective barrier for ignition apparatus 10 generally, but, further, provides a magnetic path for the magnetic circuit portion of ignition apparatus 10. Shield 36 may be grounded by way of an internal grounding strap, finger or the like (not shown) well know to those of ordinary skill in the art. Shield 36 may comprise multiple, individual sheets 36, as shown.

Low voltage connector body 38 via module 22 is configured to, among other things, electrically connect the first and second ends of primary winding 24 to an energization source, such as, the energization circuitry (e.g., power source) provided by control unit 12. Connector body 38 is generally formed of electrical insulating material, but also includes a plurality of electrically conductive output terminals 66 (e.g., pins for ground, primary winding leads, etc.). Terminals 66 are coupled electrically, internally through connector body 38 to module 22 and other portions of apparatus 10, in a manner known to those of ordinary skill in the art.

HV connector assembly 40 is provided for establishing an electrical connection to spark plug 14. Assembly 40 may include a spring 68 or the like. Contact spring 68 is in turn configured to engage a high-voltage connector terminal of spark plug 14. This arrangement for coupling the high voltage developed by secondary winding 30 to plug 14 is exemplary only; a number of alternative connector arrangements, particularly spring-biased arrangements, are known in the art.

What is claimed is:

1. An ignition apparatus comprising:

a central core extending along a main axis;

a primary winding disposed about the core;

a secondary winding disposed about the core;

wherein said primary winding has a first axial length and said secondary winding has second axial length that is less than said first axial length, wherein said secondary winding has a high voltage end configured to be connected to a spark plug and an axially opposite low-voltage end, said high voltage end being proximate a first end of said core, said core having a second end opposite said first end, an extension of said primary winding in axial length being proximate said second end of said core, wherein said primary winding comprises a plurality of layers, preselected ones of said plurality of layers having said first axial length, wherein a remainder of said layers of said primary winding are axially spaced from said low-voltage end of said secondary winding.

2. An ignition apparatus comprising:

a central core extending along a main axis;

a primary winding disposed about the core;

a secondary winding disposed about the core;

wherein said primary winding has a first axial length and said secondary winding has second axial length that is less than said first axial length, wherein said secondary winding has a high voltage end configured to be connected to a spark plug and an axially opposite low-voltage end, said high voltage end being proximate a first end of said core, said core having a second end opposite said first end, an extension of said primary winding in axial length being proximate said second end of said core, wherein said primary winding comprises a plurality of layers, preselected ones of said plurality of layers having said first axial length, wherein first and second layers of said primary winding have said first axial length, and third and fourth layers have a third axial length foreshortened relative to said first axial length and which are axially spaced apart from said low voltage end of said secondary winding.

3. The apparatus of claim 2 wherein said first and second layers are radially innermost layers of said primary winding, said third and fourth layers being radially outwardly of said first and second layers.

4. The apparatus of claim 3 wherein fifth and sixth layers of said primary winding are have said third axial length and are radially outwardly of said third and fourth layers.

5. An ignition system comprising:

an ignition apparatus including (i) a central core extending along a main axis;

(ii) a primary winding disposed on said core;

(iii) a secondary winding disposed about the core, wherein said primary winding has a first axial length and said secondary winding has second axial length that is less than said first axial length; and an ion sense biasing circuit coupled to said primary winding for charge thereof and configured to bias a spark plug coupled to a high voltage end of said secondary winding to produce an ion current indicative of a combustion condition.

6. The system of claim 5 wherein said high voltage end is proximate a first end of said core, said secondary winding having an axially opposite low-voltage end, said core having a second end opposite said first end, an extension of said primary winding in axial length being proximate said second end of said core.

7. The system of claim 6 wherein said primary winding comprises a plurality of layers, all of said layers having said first axial length.

8. The system of claim 7 wherein all of said layers of said primary winding have the same axial extent relative to said core.

9. The system of claim 6 wherein said primary winding comprises a plurality of layers, preselected ones of said plurality of layers having said first axial length.

10. The system of claim 9 wherein a remainder of said layers of said primary winding are axially spaced apart from said low-voltage end of said secondary winding.

11. The system of claim 9 wherein first and second layers of said primary winding have said first axial length, and third and fourth layers have a third axial length foreshortened relative to said first axial length and which are axially spaced apart from said low voltage end of said secondary winding.

12. The system of claim 11 wherein said first and second layers are radially innermost layers of said primary winding, said third and fourth layers being radially outwardly of said first and second layers.

13. The system of claim 12 wherein fifth and sixth layers of said primary winding are have said third axial length and are radially outwardly of said third and fourth layers.

14. A method of making an ignition apparatus configured for use with an ion sense system having a biasing circuit coupled to and charged from a primary winding of the ignition apparatus, said method comprising the step of extending the primary winding in axial length relative to a secondary winding to thereby increase leakage flux therebetween.

15. The method of claim 14 wherein said extending step comprises the substep of: configuring the primary winding such that the extension occurs proximate a first end of a central core opposite a second end of the core that is proximate a high voltage end of the secondary winding.

* * * * *